US008567102B2

(12) United States Patent
Topcuoglu

(10) Patent No.: US 8,567,102 B2
(45) Date of Patent: Oct. 29, 2013

(54) CONNECTING PIECE FOR A FREESTANDING PORTABLE DISPLAY SIGN

(76) Inventor: Ali Topcuoglu, Istanbul (TR)

( * ) Notice: Subject to any disclaimer, the term of this patent is extended or adjusted under 35 U.S.C. 154(b) by 0 days.

(21) Appl. No.: 13/513,316

(22) PCT Filed: Dec. 7, 2009

(86) PCT No.: PCT/TR2009/000148

§ 371 (c)(1),
(2), (4) Date: Jul. 10, 2012

(87) PCT Pub. No.: WO2011/071455

PCT Pub. Date: Jun. 16, 2011

(65) Prior Publication Data

US 2012/0279102 A1 Nov. 8, 2012

(51) Int. Cl.
*G09F 15/00* (2006.01)

(52) U.S. Cl.
USPC ..... 40/608; 40/611.11

(58) Field of Classification Search
USPC ..... 40/611.11, 608
See application file for complete search history.

(56) References Cited

U.S. PATENT DOCUMENTS 3,662,482 A 5/1972 Sarkisian
5,442,871 A * 8/1995 Sarkisian et al. ..... 40/606.17

FOREIGN PATENT DOCUMENTS

EP 1 120 771 A1 8/2001
WO WO 94/29835 A1 12/1994
WO WO 2005/048215 A2 5/2005

* cited by examiner

*Primary Examiner* — Casandra Davis
(74) *Attorney, Agent, or Firm* — Wood, Phillips, Katz, Clark & Mortimer

(57) ABSTRACT

Present invention relates to a connecting piece connecting legs (13) and a crossbar (10) of a free-standing portable display sign particularly suitable for installation in outdoor.

7 Claims, 4 Drawing Sheets

CONNECTING PIECE FOR A FREESTANDING PORTABLE DISPLAY SIGN

FIELD OF INVENTION

Present invention relates to a connecting piece connecting legs and a crossbar of a freestanding portable display sign particularly suitable for installation in outdoor.

BACKGROUND OF INVENTION

Freestanding portable display signs have been in extensive use for outdoor advertisement applications of any kind. Typically, a poster to be advertised is placed in a frame supported underside by leg members. In a particular arrangement, frame is also supported by spring members associated with the leg members so that the wind load exerting on the surface of the frame is damped by these springs. Legs and a crossbar extending between the legs are connected to one another by a connecting piece in such a display sign.

Such freestanding portable display sign is disclosed in EP 1721304 having a display card maintained on a support structure including a cross bar supported horizontally between two pair of leg members. Each end of the cross bar and each of the legs are independently and releasably connected to a corresponding coupling with a locking mechanism. The display card is supported on the cross bar with a pair of spring members which allow the sign to deflect in relation to the support structure when subjected to wind gusts.

As each leg members as well as the spring members is independently connected to the coupling and the crossbar respectively, considerable effort and time are needed to both mounting and demounting the display sign of EP 1721304.

U.S. Pat. No. 4,593,879 discloses an improved compact warning sign and stand, including apparatus for attaching and retaining the sign to an upstanding frame member of the stand. The apparatus comprises a pair of channels on each of opposite sides of the frame member into which a vertical cross-brace on the sign may be inserted. The frame member also includes means for permitting the sign panel to laterally pivot or swing under side-wind loads in order to allow a resilient portion of the frame base to deflect generally along a predetermined plane, preventing the sign and stand assembly from tipping over.

BRIEF DESCRIPTION OF INVENTION

One object of the present invention is to provide a connecting piece for a freestanding portable display sign, which requires minimum labor effort and time for mounting and demounting of the same.

Another object of the invention is to provide a freestanding portable display sign, which requires minimum component members for the connection of structural elements of the display sign.

The objects aimed above are achieved by a connecting piece connecting legs and a crossbar extending between the legs of a freestanding portable display sign comprising a frame having an advertisement material therein, at least one spring member supporting underside of the frame. The connecting piece of the invention is associated with the frame, i.e. body via at least one spring member, and by means of the at least one spring, the crossbar or the legs can be connected to the connecting piece, simultaneously.

According to one embodiment of the present invention, two spring members placed adjacently can be connected to the connecting piece to swing the frame when a wind load exerts thereupon. In this particular case, the first spring is fixed together with the crossbar and the second spring is fixed together with the leg members to the connecting piece. In other words, frame and the leg are associated with the connecting piece by the same fixing means; and/or frame and the crossbar are associated with the connecting piece by a separate but the same fixing means. For these connections, the connecting piece comprises mounting openings.

DESCRIPTION OF FIGURES

The present invention is to be evaluated together with annexed figures briefly described hereunder to make clear the subject embodiment and the advantages thereof.

LIST OF COMPONENT REFERENCES IN FIGURES

Figure 1:
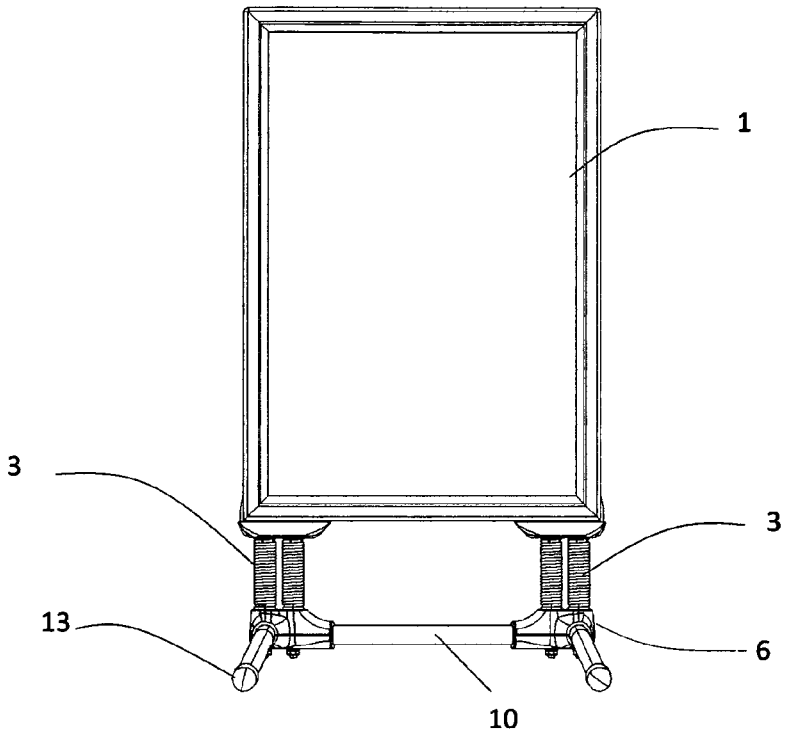
FIG. 1 is a front view of the display sign according to the invention.
Figure 2:
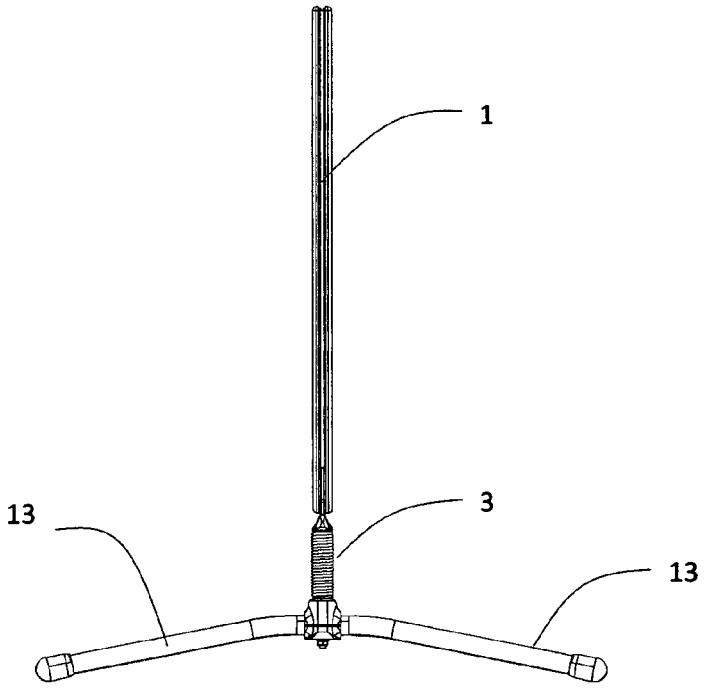
FIG. 2 is a side view of the display sign according to the invention.
Figure 3:
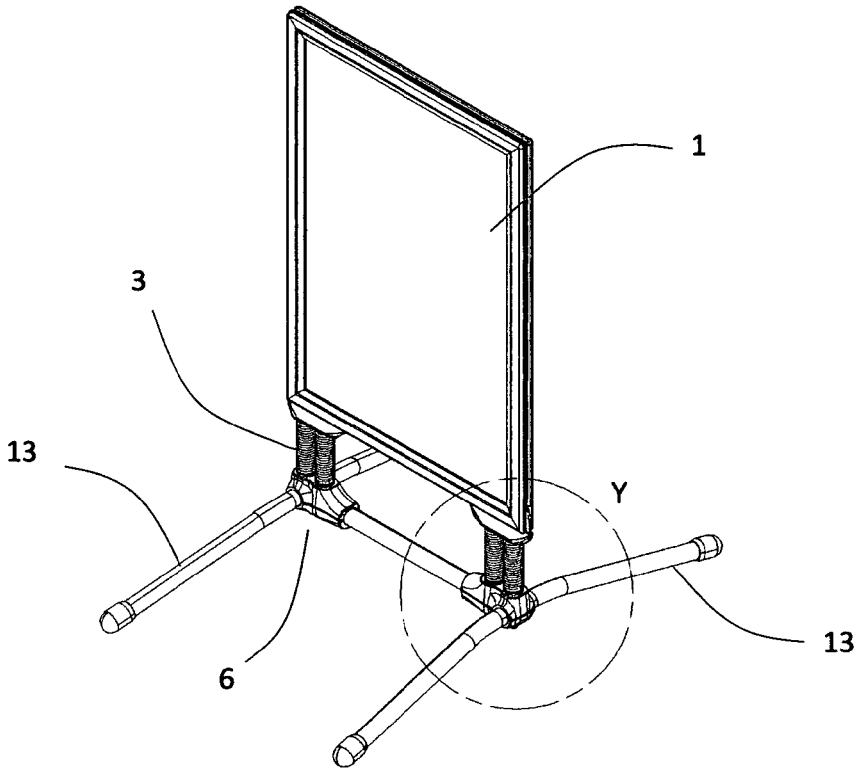
FIG. 3 is a perspective view of the display sign according to the invention.
Figure 4:
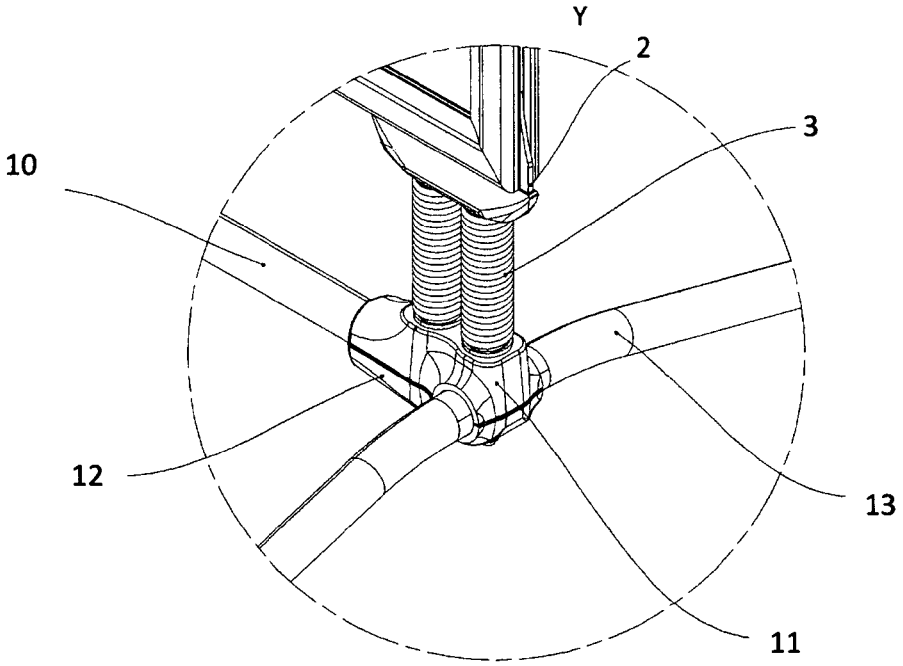
FIG. 4 is a detailed view of the spring section of the display sign shown in FIG. 3.
Figure 5:
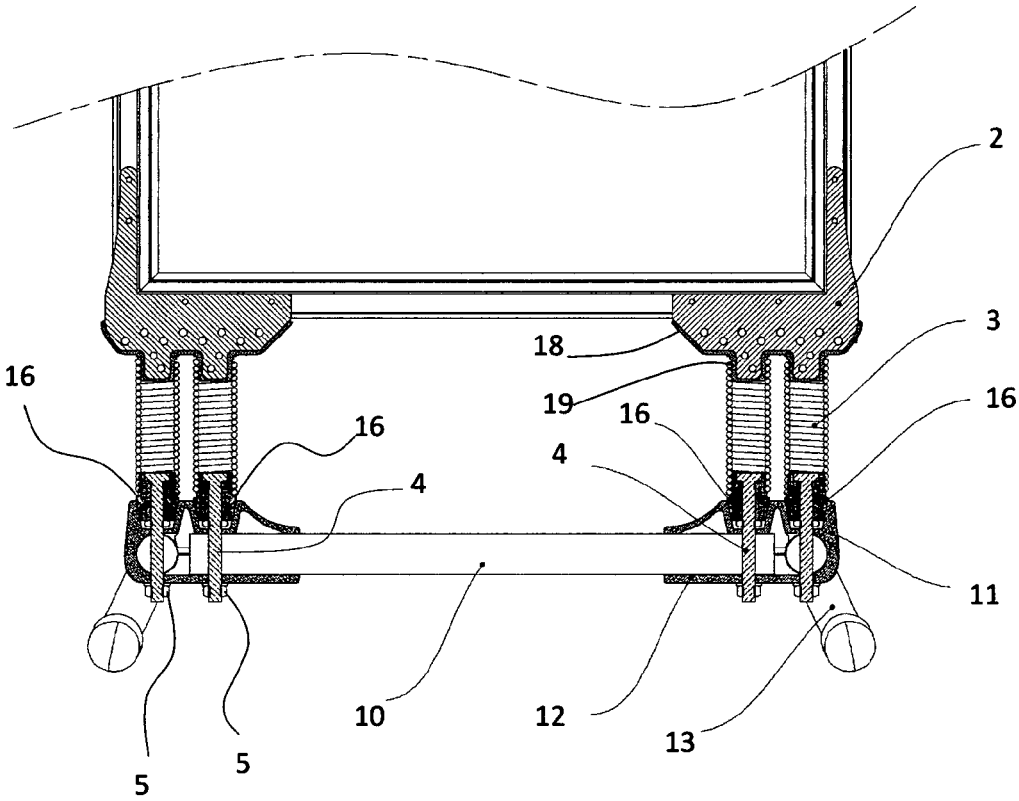
FIG. 5 is a vertical cross-section view of the display sign according to the invention.
Figure 6:
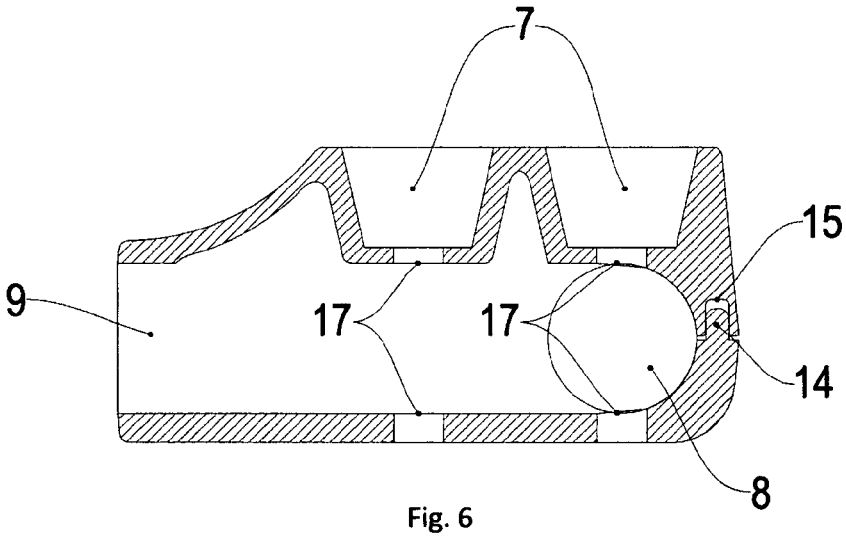
FIG. 6 is a cross-section view of the connecting piece.
Figure 7:
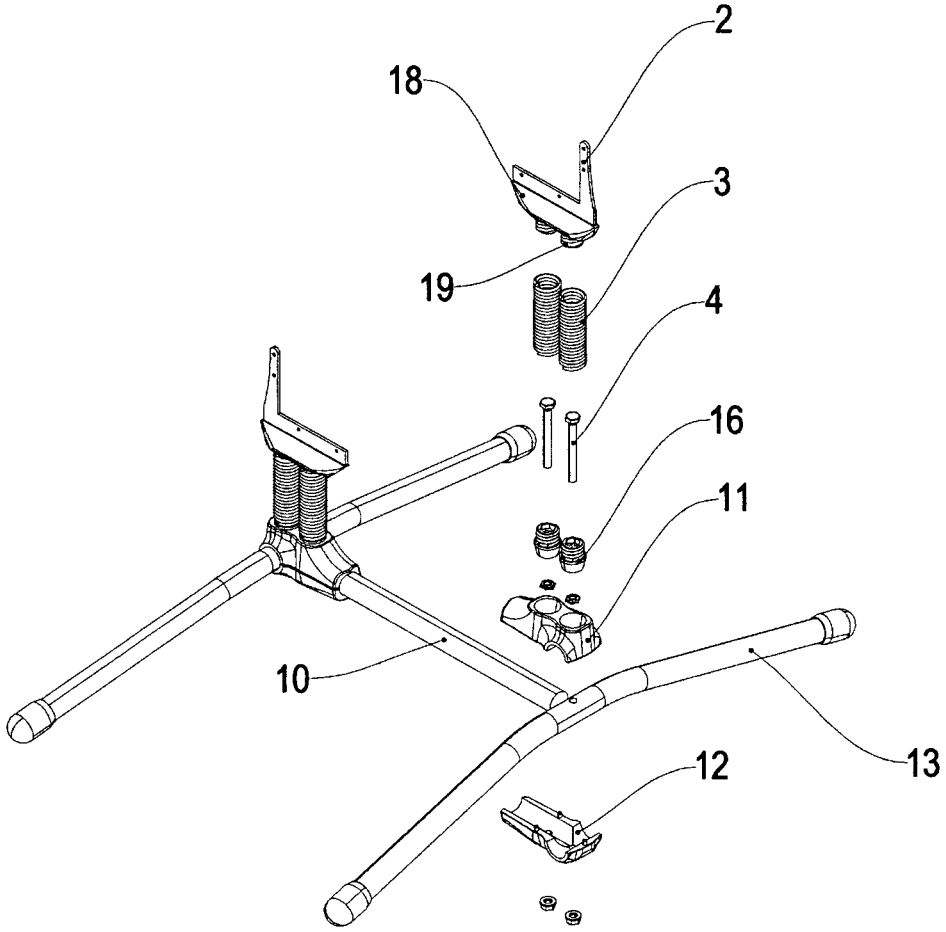
FIG. 7 is a perspective exploded view of connecting piece, legs and the bracket.

1. Frame
2. Bracket
3. Spring
4. Stud
5. Nut
6. Connecting piece
7. Nut housing
8. Leg-receiving opening
9. Crossbar-receiving opening
10. Crossbar
11. Upper piece
12. Lower piece
13. Leg
14. Protrusion
15. Recess
16. Conical nut
17. Mounting opening
18. Lower bracket member
19. Spring screw

DESCRIPTION OF INVENTION

Freestanding portable display sign comprises a frame having an advertisement material therein. Underside of the frame (1), two brackets (2) nearby the corners of the frame are provided. In order to minimize the effect of external loads, such as wind forces, on the frame, at least one spring (3) is provided underside of the frame (1). Lower bracket members (18) each extending preferably along the brackets (2) are provided. The lower bracket member (18) has, in one-piece form, spring screws (19) which are screwed to a respective spring (3). This one-piece form is preferably obtained by plastic injection molding. A preferred embodiment of the invention includes two, preferably helical, springs (3) and positioned from other ends to optionally conical housings (7) formed on connecting pieces (6).

Springs (3) are connected to the connecting piece (6) by nuts (16) having preferably conical form, which are provided underside of each spring (3) and seated to the conical housings (7), and studs (4) drawn through mounting openings (17) and tightened by nuts (5) assembled therebelow, thus, the connecting piece (6) of the invention comprises at least one, preferably two, mounting openings (17) for the connection of springs (3) thereto.

Two longitudinally extending opposite legs (13) are provided at the bottom-most of the display sign. Each leg (13) has a one-piece form and mounted to the connecting piece (6) by drawing the same through leg-receiving openings (8), aligning a mounting hole formed on the leg (11) with the corresponding mounting opening (17) and securing the same by the stud (4) and the nut (5) used also for securing one of the springs (3).

A crossbar (10) extending between the legs (11) is mounted to the connecting piece (6). Similarly, the crossbar (10) is drawn through a crossbar-receiving opening (9), aligning a mounting hole formed on the crossbar (10) with the corresponding mounting opening (17) and secured to the connecting piece (6) by the stud (4) and the nut (5) used also for securing one of the springs (3).

The connecting piece (6) has a demountable assembly comprising an upper piece (11) and a lower piece (12) mounted to each other by engaging protrusions (14) and recesses (15) formed on the respective pieces (11, 12). This demountable assembly is advantageous, in particular, mounting the crossbars (10) and the legs (13) to the connecting pieces (6). In a typical mounting process, the crossbar (10) and the leg (13) are positioned to the locations on the lower piece (12) and the upper piece (11) is mounted to the lower piece (12) and then studs (4) are connected to the connecting piece (6).

According to an alternative embodiment, frame (1), i.e. body, can be associated with the connecting piece (6) without using spring members (3). This alternative embodiment can be useful in places where such display signs are not exerted wind loads.

The connecting piece (6) can be of various materials suitable for exhibiting good mechanical and corrosive properties, such as a plastic material (polyamide or polypropylene etc).

The invention claimed is:

1. A connecting piece (6) connecting legs (13) and a crossbar (10) extending between the legs (13) of a freestanding portable display sign comprising a frame (1) having an advertisement material therein, at least one spring member (3) supporting underside of the frame (1), characterized in that the connecting piece (6) comprises mounting openings (17) connecting the frame (1), the legs (13), and the crossbar (10) by a fixing means; and nut housings (7) having conical form are formed on the connecting piece (6) for seating conical nuts (16).

2. A connecting piece according to claim 1, wherein lower bracket members (18) provided underside of brackets (2) comprise, in one-piece form, spring screws (19) which are screwed to a respective spring (3).

3. A connecting piece according to claim 1, wherein the fixing means comprises a stud (4), a nut (5) and a conical nut (16).

4. A connecting piece (6) connecting legs (13) and a crossbar (10) extending between the legs (13) of a freestanding portable display sign comprising a frame (1) having an advertisement material therein, at least one spring member (3) supporting underside of the frame (1), characterized in that the connecting piece (6) comprises mounting openings (17) connecting the frame (1), the legs (13), and the crossbar (10) by a fixing means; wherein the connecting piece (6) comprises an upper piece (11) mountable to and demountable from a lower piece (12) by engaging protrusions (14) and recesses (15) formed on the upper and lower pieces (11, 12).

5. A connecting piece according to claim 4, wherein lower bracket members (18) provided underside of brackets (2) comprise, in one-piece form, spring screws (19) which are screwed to a respective spring (3).

6. A connecting piece (6) connecting legs (13) and a crossbar (10) extending between the legs (13) of a freestanding portable display sign comprising a frame (1) having an advertisement material therein, at least one spring member (3) supporting underside of the frame (1), characterized in that the connecting piece (6) comprises mounting openings (17) connecting the frame (1), the legs (13), and the crossbar (10) by a fixing means; wherein lower bracket members (18) provided underside of brackets (2) comprise, in one-piece form, spring screws (19) which are screwed to a respective: spring (3).

7. A connecting piece according to claim 6, wherein the fixing means comprises a stud (4), a nut (5) and a conical nut (16).

* * * * *